US005332128A

United States Patent [19]

Mass et al.

[11] Patent Number: 5,332,128

[45] Date of Patent: Jul. 26, 1994

[54] FLAP VALVE ASSEMBLY FOR TRIGGER SPRAYER

[75] Inventors: Wilhelmus J. J. Mass; Petrus L. W. Hurkmans, both of Someren, Netherlands

[73] Assignee: AFA Products, Inc., Forest City, N.C.

[21] Appl. No.: 840,761

[22] Filed: Feb. 24, 1992

[51] Int. Cl.[5] ..... B67D 5/40

[52] U.S. Cl. ..... 222/383

[58] Field of Search ..... 239/333; 222/340, 341, 222/380, 382, 383

[56] References Cited

U.S. PATENT DOCUMENTS

| | | | |
|---|---|---|---|
| Re. 33,235 | 6/1990 | Corsette | 239/333 X |
| 1,464,419 | 8/1923 | Gill | 222/382 |
| 3,973,700 | 8/1976 | Schmidt et al. | 222/380 X |
| 4,155,487 | 5/1979 | Blake | 222/383 X |
| 4,225,061 | 9/1980 | Blake et al. | 222/383 X |
| 4,230,277 | 10/1980 | Tada | 239/333 |
| 4,235,353 | 11/1980 | Capra et al. | 222/256 |
| 4,241,853 | 12/1980 | Pauls et al. | 222/207 |
| 4,410,107 | 1/1983 | Corsette | 222/380 |
| 4,618,077 | 10/1986 | Corsette | 222/383 |
| 4,819,835 | 4/1989 | Tasaki | 222/383 |
| 4,890,773 | 1/1990 | Corsette | 222/380 |
| 4,958,754 | 9/1990 | Dennis | 239/333 X |
| 5,169,032 | 12/1992 | Steijns et al. | 222/380 X |

*Primary Examiner*—Andres Kashnikow
*Assistant Examiner*—Kenneth Bomberg
*Attorney, Agent, or Firm*—Thomas R. Vigil

[57] ABSTRACT

The pumping mechanism is used in a trigger operated fluid dispensing device, e.g. a trigger sprayer, for pumping fluid from a storage container into a discharge end of a body of the dispensing device. The pumping mechanism includes a chamber within the body of the trigger sprayer, a piston received in the cylinder, two flap valves associated with an internal back wall of the chamber, and a manually operated trigger movably connected to the body of the dispensing device and coupled to an outer end of the piston. The flap valves are normally closed and pressure controlled to ensure a quick filling and emptying of the collection chamber.

17 Claims, 4 Drawing Sheets

FLAP VALVE ASSEMBLY FOR TRIGGER SPRAYER

BACKGROUND OF THE INVENTION

1. Field of the Invention

The present invention relates to a trigger operated dispensing device, e.g. a trigger sprayer, for mounting on a storage container. This trigger sprayer includes a pumping mechanism to pump a desired amount of fluid out of the container for discharging the same for a certain application.

The pumping mechanism uses two operating cycles to pump a certain amount of fluid: the fluid ejection stroke and the fluid intake stroke. During the fluid intake stroke fluid is sucked from the container through an inlet flap valve into a pumping chamber. During the fluid ejection stroke, the fluid is pumped from the pumping chamber through an outlet flap valve, an outlet passageway and a discharge end of the dispensing device into the atmosphere.

2. Description of the Related Art

Heretofore, various trigger sprayers have been proposed. Some examples of these previously proposed trigger sprayers are disclosed in the following patents:

| U.S. Pat. No. | Patentee |
|---|---|
| 4,819,835 | Tasaki |
| 4,235,353 | Capra et al. |
| 4,618,077 | Corsette |
| 4,241,853 | Pauls et al. |

In the Tasaki U.S. Pat. No. 4,819,835 there is disclosed a trigger sprayer having a pumping mechanism including an inlet valve, an outlet valve, an intervalve chamber and a cylindrical collection chamber. A piston unit, in conjunction with a trigger and a spring are used to vary the volume of the collection chamber. A passageway connects the collection chamber with the intervalve chamber to establish a pressure balance between those chambers. The passageway between both chambers is fairly small, compared to the size of the chambers, and therefore the pressure balance between the chambers occur after the completion of an ejection stroke.

During the intake stroke, a vacuum is created within the collection chamber and communicates through the passageway to the intervalve chamber by moving the piston to increase the volume of the collection chamber. This vacuum forces an inlet ball valve open by lifting the ball to suck fluid from the container into the intervalve chamber and through the passageway into the collection chamber. During the fluid ejection stroke the piston is moved to decrease the volume of the collection chamber and to increase the pressure in the collection chamber and the intervalve chamber. This pressure lifts a fairly heavy exhaust valve body of the fluid outlet valve to open the outlet valve and to eject the fluid into the atmosphere.

In the Capra et al. U.S. Pat. No. 4,235,353 there is disclosed a trigger sprayer having a pumping mechanism including a piston chamber and an accumulating chamber. The pumping mechanism is operated to pump the fluid from the container into the accumulating chamber by sucking the fluid via an inlet ball valve into the piston chamber and, subsequently, by forcing the fluid through an inlet flap valve into the accumulating chamber. When pressure in the piston chamber is higher than the pressure in the accumulation chamber, the inlet flap valve is forced open for allowing the fluid to enter the accumulating chamber. The incoming fluid increases the pressure inside the accumulating chamber against a moveable wall and a spring mounted therein. An outlet opening of the accumulating chamber is closed by an outlet flap valve.

To dispense the fluid into the atmosphere, the operator has to press down on a discharge nozzle on a stem. The stem forces an outlet flap valve of the accumulating chamber open and the pressure and the spring biased piston inside the accumulating chamber pushes the fluid past the outlet flap valve into the atmosphere. As soon as the operator stops pressing down the discharge nozzle, the outlet flap valve is forced closed again.

In the Corsette U.S. Pat. No. 4,618,077 there is disclosed a pumping mechanism of a trigger sprayer including a pump chamber enclosed by a cylindrical member with an inner cone top. The cone top fits tight in a conical end wall and incorporates a normally closed check valve. The check valve is in the top part of the cone top and closes an inlet port within the conical end wall by touching the wall. An accumulation chamber is located between the conical end wall and the cylindrical member. A ring extending around the conical end wall and an annular flange on the outside of the cylindrical member seals an outlet port from the accumulation chamber to a discharge passageway in the trigger sprayer. A vacuum inside the pump chamber opens the check valve and allows the fluid to pass through the inlet port into the pump chamber. The pressure inside the pump chamber is communicated to and establishes a pressure in the accumulating chamber which results in the moving of the annular flange on the outside of the cylindrical member in an axial direction away from the ring extending around the conical end wall to allow the fluid to pass through the outlet port into the discharge passageway.

In the Pauls et al. U.S. Pat. No. 4,241,852 there is disclosed a trigger sprayer with a resilient bladder enclosing an accumulation chamber and a charging chamber enclosing a piston. The bladder has a relatively thin, flexible, forwardly projecting, cylindrical valve wall formed on the forward wall surface thereof and an annular radially inwardly directed flexible valve ring is formed substantially coplaner with the forward end wall surface of the bladder. The cylindrical valve wall is received in a rearwardly facing wall of the charging chamber. A vacuum in the charging chamber pulls the flexible valve ring against an extension of the cylindrical wall of the charging chamber to close it and lifts the far end of the cylindrical valve wall from its position in the rearwardly facing wall to create an opening towards the container to allow fluid to be sucked into the charging chamber. By establishing a pressure in the charging chamber the situation becomes reciprocated and fluid is moved into the accumulation chamber.

The pumping mechanism of the present invention including a pumping chamber and pressure controlled flap valves integrated therein is significantly different from the prior Takaki, Capra et al., Corsette and Pauls et al. pumping mechanisms described above.

As will be described in greater detail hereinafter, the pumping mechanism of the present invention with its single pumping chamber and pressure controlled flap valves associated therewith enhances the priming performance of the trigger sprayer significantly. Because of the close proximity of both flap valves associated with a back internal wall of the pumping chamber, the unusable dead volume in the pumping chamber is minimized. The small dead volume of the pumping chamber combined with the pressure controlled flap valves allows a quick pressure or vacuum increase to be established inside the pumping chamber during an ejection stroke or an intake stroke and minimizes the number of pre-pumping strokes required during priming of the trigger sprayer.

SUMMARY OF THE INVENTION

The present invention relates to a pumping mechanism for a trigger operated fluid dispensing device, e.g. a trigger sprayer, for pumping fluid from a storage container into a discharge end of a body of the dispensing device. The pumping mechanism includes a chamber within the body of the trigger sprayer, a piston, two flap valves associated with an internal back wall of the chamber, and a manually operated trigger movably connected to the body of the dispensing device and coupled to an outer end of the piston. The flap valves are normally closed and pressure controlled to ensure a quick filling and emptying of the collection chamber.

During the fluid intake stroke, a vacuum inside the collection chamber opens an inlet flap valve and sucks fluid from the container via an inlet opening into the collection chamber. During the fluid ejection stroke the pressure inside the collection chamber closes the fluid inlet flap valve and forces open a fluid outlet flap valve associated with the integral back wall to force the fluid through an outlet opening and a discharge passageway into the atmosphere.

DESCRIPTION OF THE PREFERRED EMBODIMENT(S)

Figure 1:
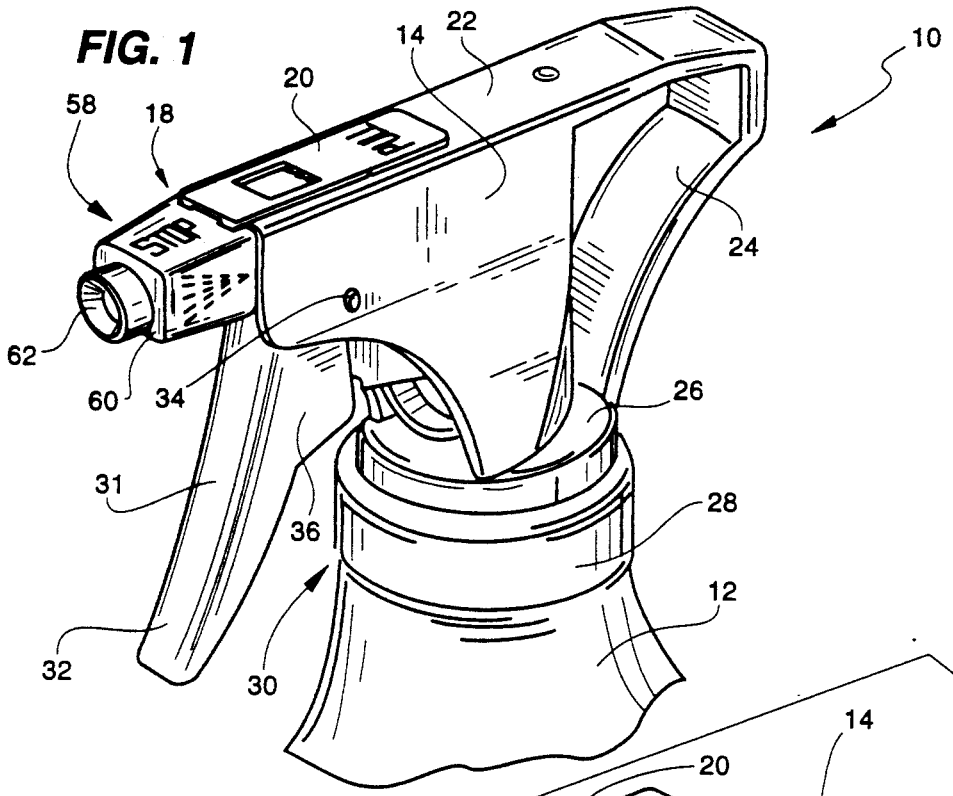
FIG. 1 is a perspective view of a trigger sprayer constructed according to the teachings of the present invention.

Referring now to the drawings in greater detail, there is illustrated in FIG. 1 a perspective view of an all synthetic/plastic trigger sprayer 10 coupled to a bottle 12.

Figure 2:
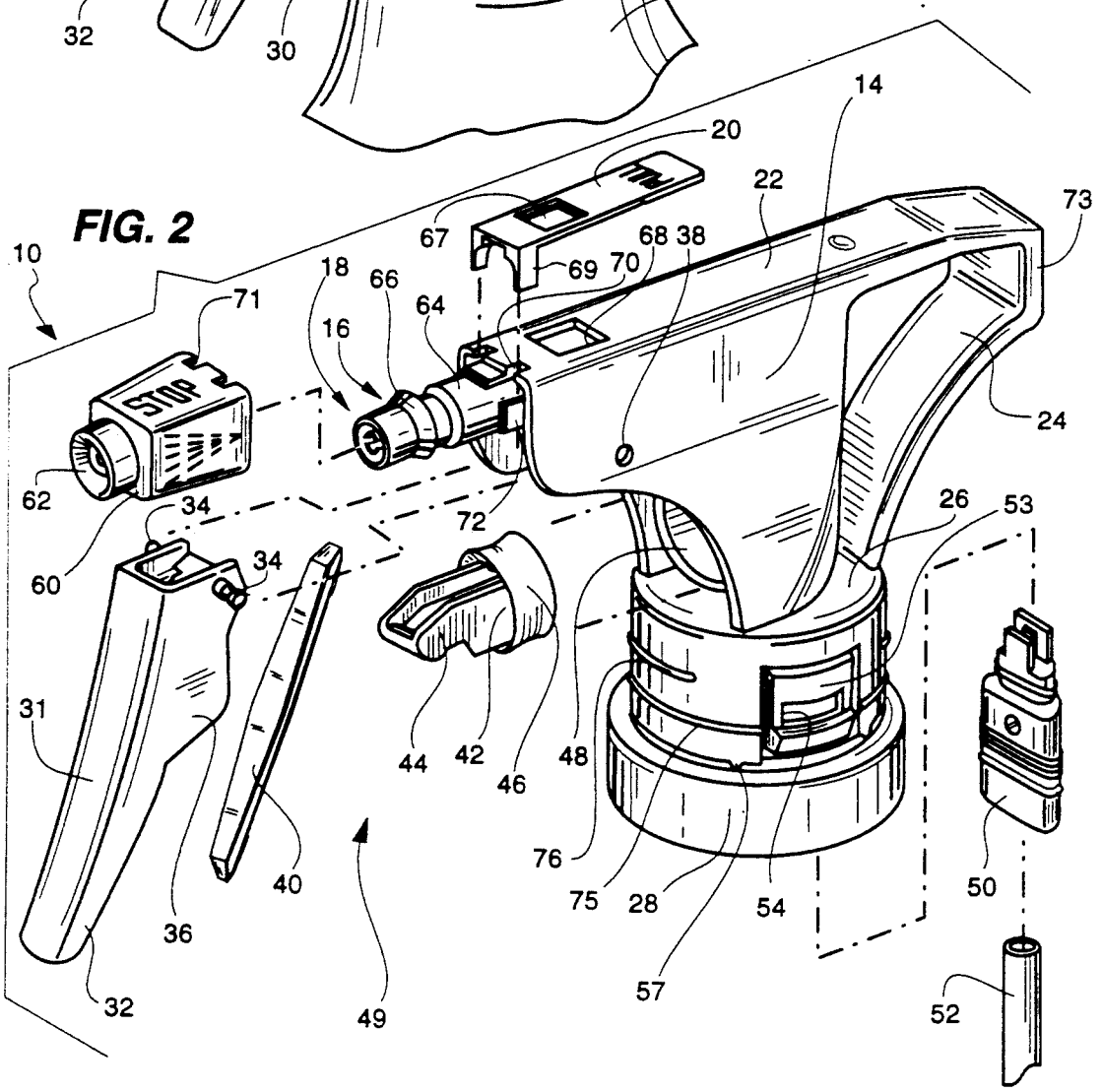
FIG. 2 is an exploded perspective view of the trigger sprayer shown in FIG. 1 and shows a locking ring prior to its detachment from a cylindrical base of the sprayer body.

An exploded perspective view of the parts of the trigger sprayer 10 is shown in more detail in FIG. 2.

The trigger sprayer 10 includes a body 14, a nose bushing 16 at a discharge end 18 of the body 14, a nozzle tamper proof pull away piece 20, a top portion 22 and a hand gripping formation 24 extending rearwardly from the top portion 22 of the body 14 and then downwardly to a cylindrical base 26 of the body 14. The base 26 is held by a locking ring 28 to a neck 30 of the bottle 12.

A trigger 32 having a front side 31 is pivotally mounted to the body 14 by having two cylindrical pins 34, molded on the top end of two opposed side walls 36 of the trigger 32, inserted into two corresponding holes 38 in the body 14 of the trigger sprayer 10.

As shown in FIG. 2, a plastic spring assembly 40 is placed between the body 14 and the trigger 32 to urge the trigger 32 always back into its home position. Coupled to the trigger 32 is a piston 42 having an outer piston rod 44 which connects with the trigger 32 and an inner cylindrical end 46 which is received in a cylindrical opening 48 in the body 14 for the purpose of varying the volume in a pumping chamber defined in the opening 48.

The trigger 32, the spring assembly 40, the piston 42 and the cylindrical opening 48 form and define primary components of a pumping mechanism 49.

A valve intake stem 50 is received into the bottom of the cylindrical base 26 and has a dip tube 52 releasably fixed thereto and depending therefrom for insertion into the bottle 12.

A safe and child resistant sprayer/bottle connection is provided and includes locking tabs 53 with lug receiving openings 54 formed in the cylindrical side wall of the cylindrical base 26 and locking lugs on the bottle neck 30 and locked in place by the locking ring 28.

When the molded sprayer body is removed from a mold, the locking ring 28, connected to the cylindrical base 26 of the body 14 by six links, points, fillets or webs 57 which are necessary for molding the locking ring 28 together with the body 14 is broken away from the cylindrical base 26 by breaking the fillets 57 and moved upwardly on the base. During assembly of the parts of the trigger sprayer 10, the locking ring 28 is moved downwardly over the cylindrical base 26.

A nozzle assembly 58 is provided and includes a rotatable nozzle cap 60 having a forwardly extending cylindrical extension 62. The nozzle cap 60 is mounted on the nose bushing 16 extending from a cylindrical portion 64 of the body 14 and includes an annular band 66 for holding the nozzle cap 60.

Three different positions of the nozzle cap 60, a STOP position, a SPRAY position, and a STREAM position are provided.

When the nozzle assembly 58 is mounted to the body 14, a mounting block 67 of the piece 20 is snap fittingly received through an opening 68 in the top portion 22. At the same time, fork arms 69 of the piece 20 extend through notches 70 in the top portion 22 and/or notches 71 in the top wall of the cap 60 between one of two flexible locking legs or prongs 72 and the cylindrical portion 64 for securing the nozzle cap 60 in its STOP position,. thereby ensuring a tamper proof and child resistant locking of the trigger sprayer nozzle assembly 58 to the body 14.

The nozzle assembly 58 is mounted on the discharge end 18 of trigger sprayer 10, as described above. The top portion 22 of the body 14 extends rearwardly to a rear end of the hand gripping formation 24 and then slants forwardly and downwardly from the rear end 73 to the cylindrical base 26.

The six contact fillets or webs 57 are uniformly distributed around the lower end of the cylindrical base 26 and are initially integral with the locking ring 28. During the molding process, the contact fillets or webs 57 are broken and the locking ring 28 is moved upwardly relative to the cylindrical base 26. Later, when the locking ring 28 is moved downwardly on the base 26, an annular groove 74 within the locking ring 28 snap-fittingly mates with an annular rib 75 on the base 26. The upper position of the locking ring 28 is the preheld in this position by frictional engagement of the inner wall of the locking ring 28 with the rib segments 76 provided on the outer cylindrical wall of the cylindrical base 26. The upper, partially annular rib segments 76 on the outer cylindrical wall of the cylindrical base 26 locate and to some extent limit upward movement of the locking ring 28.

Figure 3:
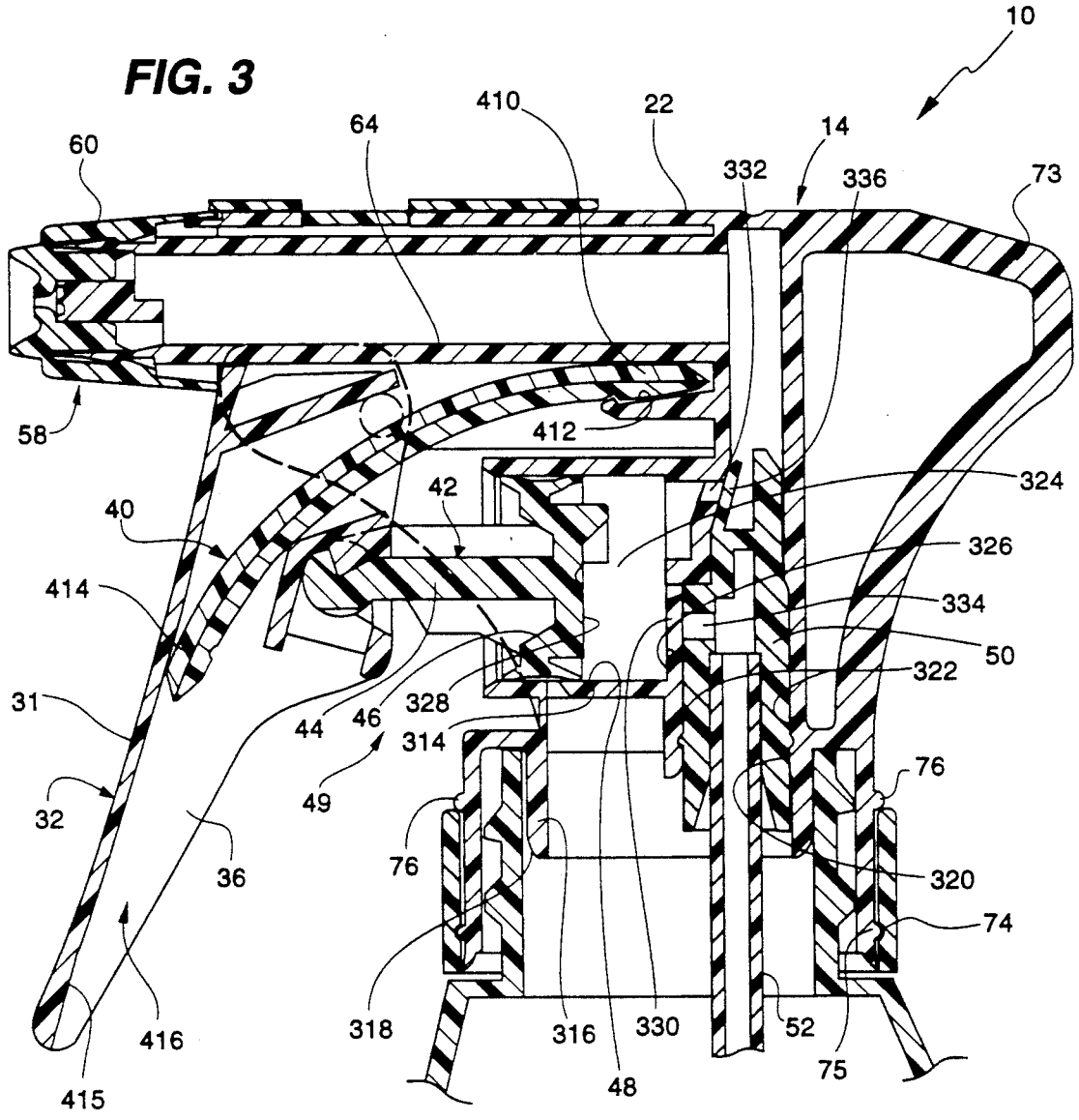
FIG. 3 is a vertical sectional view of the trigger sprayer in its at rest position where a spring between a trigger and the sprayer body biases the trigger and a piston rod coupled thereto to the most outward position.

As shown in FIG. 3, molded within the cylindrical base 26 to a top wall 314 of the cylindrical base 26 is a small diameter seal ring 316. The seal ring 316 is designed to seal against the inner diameter of the bottle neck 30. The seal ring 316 has a bevelled end 318 at its lower side to facilitate insertion of the bottle neck 30 into the base 26 and around the seal ring 316.

Within the inner area of seal ring 316 is an opening 320, having a shape according to the shape of the intake stem 50 which is generally oval in cross-section. The intake stem 50 is press-fitted into the opening 320 until ridges 322 on the intake stem 50 snap into mating mounting grooves on the inner surface of the wall of the opening 320. In this way, an air tight seal is provided. The dip tube 52 is releasably fixed in the center of the intake stem 50. The length of the dip tube 52 depends on the size of the bottle 12. However, it is recommended that the dip tube 52 should extend to the bottom of the bottle 12 but shouldn't touch it.

The cylindrical opening 48 is located inside the body 14 of the trigger sprayer 10. The piston cylindrical end 46 fits tightly into the cylindrical opening 48 to create a pumping chamber 324 having a variable volume between a fixed back wall 326 of the cylindrical opening 48 and a rearwardly facing wall 328 of the piston cylindrical end 46. The fixed wall 326 of the pumping chamber 324 has an inlet flap valve 330 situated in the lower part thereof and an opening 332 in the upper part thereof. An orifice 334 through a wall of the intake stem 50 is located to mate or register with the inlet flap valve 330 and to establish an inlet passageway. The inlet passageway is provided by the hollow dip tube 52, the intake stem 50 and the orifice 334.

The opening 332 is located to mate or register with an outlet flap valve 336 on the top side of intake stem 50. Inlet flap valve 330 and outlet flap valve 336 control the fluid flow into and out of pumping chamber 324.

The trigger 32 is pivotally mounted on the body 14 of the trigger sprayer 10 by inserting the two laterally extending pins 34 on the upper part of the trigger 32 into the two corresponding holes 38 in the body 14. The plastic spring assembly 40 has a flat tapered end 410 press-fitted into a recess 412 in the body 14 located underneath an inner end of the cylindrical portion 64 of the body 14. Another end 414 of the plastic spring assembly 40 is placed in a trough-like space 416 in the back side of the trigger 32 against a back wall 415. The plastic spring assembly 40 is bent and remains under stress to urge the trigger 32 always back into its home position.

Figure 4:
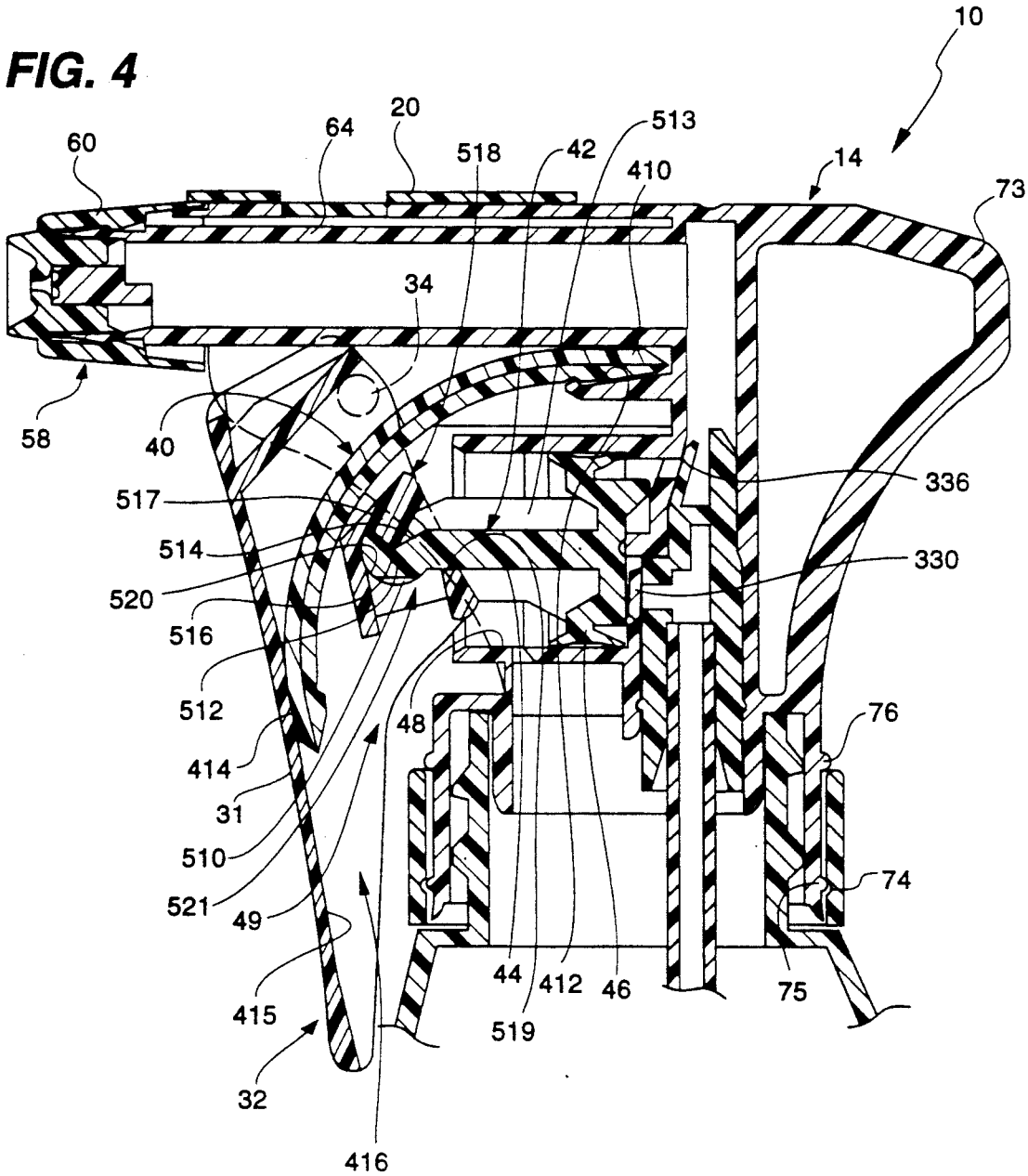
FIG. 4 is a vertical sectional view of the trigger sprayer similar to the view shown in FIG. 1 but showing the trigger fully depressed.

FIG. 4 shows the trigger sprayer 10 with the trigger 32 pressed in by the operator. The pressure in the pumping chamber 324 opens outlet flap valve 336 so that the fluid can leave pumping chamber 324. At the same time, the plastic spring assembly 40 is bent and stressed even more, but it is not stretched above its Hook limit, and the operator needs a maximum force to keep the trigger 32 pressed in.

After the operator stops pressing trigger 32, the plastic spring assembly 40 urges the trigger 32 together with piston 42 back into their home positions. While the piston 42 moves back, a vacuum arises inside the pumping chamber 324. This vacuum opens inlet flap valve 330 and sucks in fluid from the bottle 12.

Figure 5:
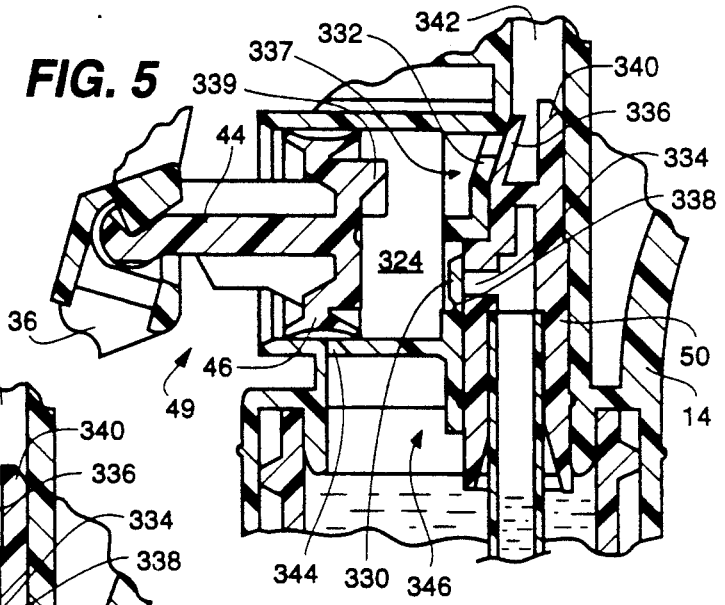
FIG. 5 is an enlarged fragmentary vertical sectional view of the pumping mechanism of the trigger sprayer shown in FIGS. 3 and 4 and shows a pumping chamber of the pumping mechanism in a pre-operating position.

This working cycle is illustrated in more detail in FIGS. 5–8. FIG. 5 shows the pumping chamber 324 and a part of pumping mechanism 49 in a pre-operating position, that means, in a position just after assembling all the parts of trigger sprayer 10 and before doing the very first stroke. FIG. 5 shows the pumping chamber 324 at its largest possible size, because of the plastic spring assembly 40 urging the trigger 32 and piston 42 into their home positions. The flap valves 330 and 336 are both in their initial positions. Outlet flap valve 336 is movable on the top end of intake stem 50 and normally presses opening 332 to close it. Inlet flap valve 330 is formed with a thinner or weakened line area which forms a hinge 338 for flap valve 330 inside body 14 of trigger sprayer 10 and normally presses against the wall around the orifice 334 in the intake stem 50 to close it. The flap valves 330 and 336 are made out of the same plastic material as the parts they are molded integral with. They have a rectangular shape and they are connected only on their lower side with the part they are molded with. The flap valve 330 has in addition thereto the predetermined bending point or hinge 338.

Figure 6:
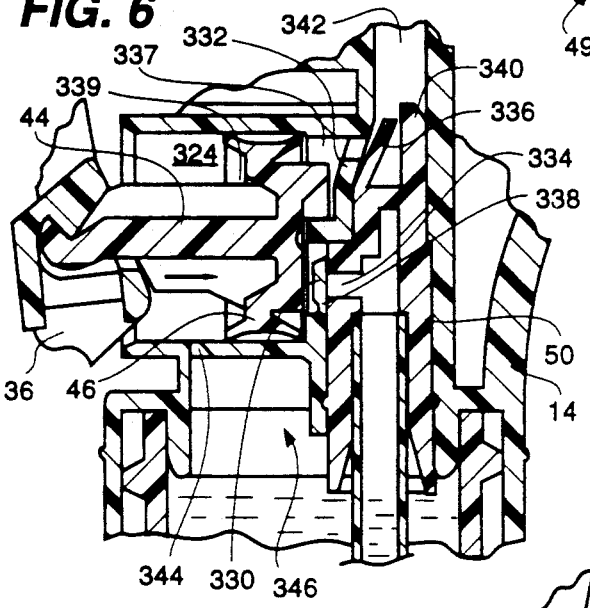
FIG. 6 is an enlarged fragmentary vertical sectional view of the pumping mechanism, similar to the view in FIG. 5, but after the first fluid ejection priming stroke.

FIG. 6 shows the pumping chamber 324 and a part of the pumping mechanism 49 after the first pressure stroke by the operator. The pumping chamber 324 is now at its smallest possible size. An extension 339 attached to the cylindrical end 46 of piston 42 mates with a relief 337 in the fixed back wall 326, thereby minimizing the remaining volume of the pumping chamber 324.

During the pressure stroke, the air inside the pumping chamber 324 is compressed. When the pressure in pumping chamber 324 reaches a certain level, the air pushes inlet flap valve 330 against intake stem 50 to close orifice 334 and pushes outlet flap valve 336 against an upper post 340 extending from the upper side of intake stem 50 to the point where the flap valve 336 flexes to open the opening 332 and to press the air out of the pumping chamber 324 into an outlet passageway 342. The flap valve 336 can be constructed and arranged to rest against the post 340 in the at rest position to ensure a pressure engagement of the flap 336 against the surface area around the opening 332 to prevent leaking, with the pressure created on a pressure stroke being sufficient to move the flap 336 enough away from the opening 332 to allow liquid to escape from the chamber 324 into the outlet passageway 342. The volume of the contracted pumping chamber 324 is one twentieth to one fourth of the full volume of the pumping chamber 324 shown in FIG. 5.

Figure 7:
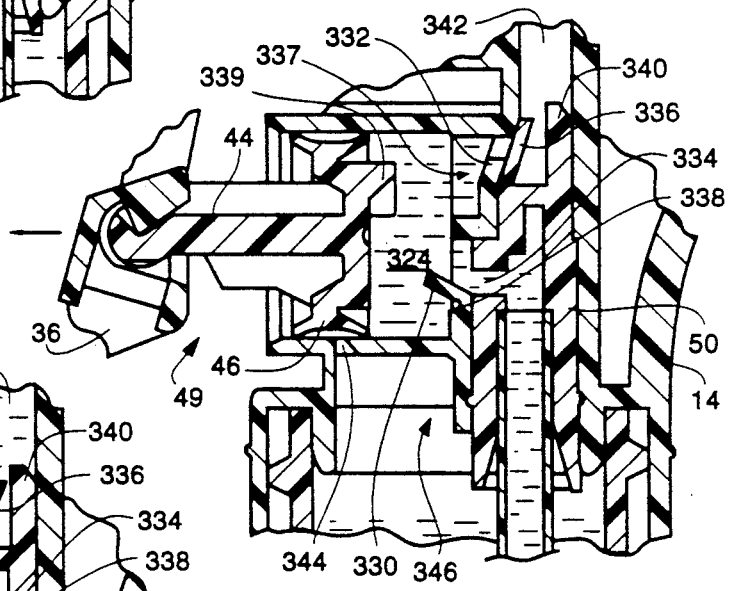
FIG. 7 is an enlarged fragmentary vertical sectional view of the pumping mechanism, similar to the view in FIG. 5, but after a fluid intake stroke.

FIG. 7 shows the pumping chamber 324 and a part of the pumping mechanism 49 after the fluid intake stroke. The trigger 32 and the piston 42 connected therewith are urged back by the plastic spring assembly 40. The enlarging of the volume of the pumping chamber 324 causes a vacuum inside the pumping chamber 324. The vacuum sucks against the outlet flap valve 336 to close the opening 332 and the vacuum also sucks the inlet flap valve 330 into pumping chamber 324 to open orifice 334 in intake stem 50 thereby to suck fluid out of the bottle 12 into the pumping chamber 324.

Figure 8:
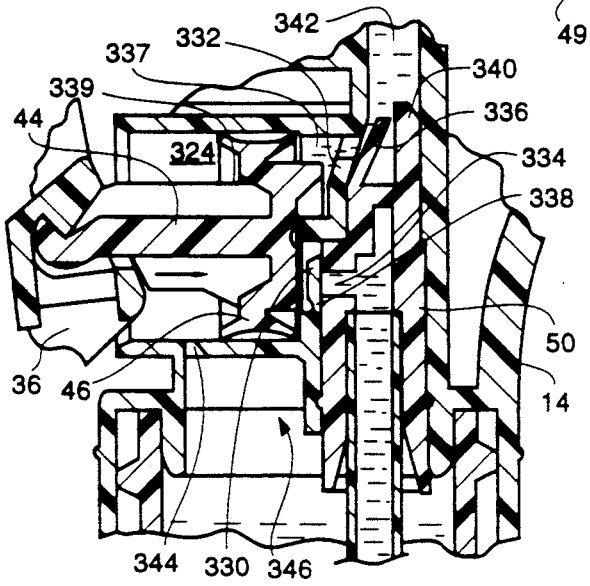
FIG. 8 is an enlarged fragmentary vertical sectional view of the pumping mechanism, similar to the view in FIG. 5, but after a fluid ejection stroke.

After the pumping chamber 324 has reached its maximum size again, the fluid ejection stroke follows, as shown in FIG. 8. The operator forces the fluid against the flap valves 330 and 336 by pressing the trigger 32 and causing the inlet flap valve 330 to close the orifice 334 and the outlet flap valve 336 to open the opening 332 to force the fluid inside the pumping chamber 324 to move into the atmosphere via the outlet passageway 342, the cylindrical portion 64 and the nozzle assembly 58, shown in FIG. 4.

When the fluid is sucked out of the bottle 12, and because the bottle 12 and the trigger sprayer 10 connection is air tight, a vacuum arises within the bottle 12. To avoid a vacuum within the bottle 12, a venting system in provided. The venting system includes a vent hole 344 is the top wall 314 of the cylindrical base 26. This part of the top wall 314 defines a wall area between the lower side of the cylindrical opening 48 inside body 14 of trigger sprayer 10 and a cylindrical cavity 346 within cylindrical base 26. When the trigger 32 is fully pressed in, vent hole 344 is opened and a fluid connection between the inside of the bottle 12 and the atmosphere is established so that air is able to get into the bottle 12. When the trigger 32 is not pressed in, e.g. when it is in its home position, the vent hole 344 is covered by the cylindrical end 46 of the piston 42 to close the vent hole 344 thereby preventing fluid from coming out of the bottle 12.

The pumping chamber 324 is designed so that, the "dead volume", i.e. the minimum volume of the pumping chamber 324, is very small, 1/20 to ¼ the full volume of pumping chamber 324. With a small dead volume, only a very little amount of the fluid or air is left in the pumping chamber 324, after the trigger 32 is fully pressed in. This construction minimizes the size of compressible air space inside the pumping chamber 324 and allows the trigger sprayer 10 to build higher compression against the flap valve 330 during the priming of the trigger sprayer 10. This minimized "dead volume" provides for quicker priming of the trigger sprayer 10 and higher vacuum and high compression during the intake and ejection strokes.

Another effect of the small "dead volume" is that the pumping chamber 324 is filled up with fluid very quickly therefore reducing the number of initial strokes required to prime the trigger sprayer 10.

As shown in FIG. 4, an outer end 510 of the piston rod 44 has a transversely located cylinder 512. The cylinder 512 is located transversely to the longitudinal axis of the piston rod 44 between legs 513 and has an axially extending V in cross section slot 514 in the middle thereof for receiving a pivot edge 516 of a hook 517 extending between the sides 36 of the trigger 32. The hook 517 is part of a bearing formation 518 which is provided on the backside of trigger 32 between the sides 36 and which has an opening 519 through which the outer end 510 is received. The cylinder 512 engages in and rests upon bearing seats 520 on either side of a lower slot 521 communicating with the opening 519 in the bearing formation 518 of the trigger 32 and the sides of the V shaped slot 514 act as (or form) stops to limit the rotational freedom of the connected parts. The bearing formation 518, in combination with the V shaped slot 514, establish a movable trigger 32—piston 42 connection with limited, but sufficient, rotational freedom. This enables the piston 42 to be moved within the pumping chamber 324 while being pivotally connected to trigger 32 in a simple and efficient manner.

It also will be apparent from the foregoing description that modifications can be made to the flap valve assembly of the present invention without departing from the teachings of the present invention.

Accordingly, the scope of the present invention is only to be limited as necessitated by the accompanying claims.

We claim:

1. A trigger operated pumping mechanism for a fluid dispensing device comprising a body, said pumping mechanism comprising:

a piston having a rearwardly facing moveable wall;

a trigger movably mounted to said body;

said piston being coupled to said trigger for moving said moveable wall;

said body having a hollow cylinder therein which receives said piston and which extends to a fixed back wall in said body, whereby the space between said back wall and said moveable piston wall defines a variable volume pumping chamber;

said cylinder having a fluid inlet valve and a fluid outlet valve associated with said back wall;

said valves being pressure controlled; and the volume of said pumping chamber at the end of an ejection stroke of said piston being minimized by constructing and arranging said inlet and outlet valves as plastic flap valves which are each located in or adjacent said back wall of said cylinder for arcuate movement about a hinge line and by constructing and arranging said movable wall and said cylinder to have a minimum remaining space between said back wall and said movable wall at the end of the ejection stroke of said piston, thereby to facilitate the creation of high vacuum and high pressure during intake and ejection strokes of said piston and to facilitate priming with a minimum of strokes.

2. The pumping mechanism of claim 1 wherein said piston, said cylinder and the length of movement of said piston in said cylinder are constructed and arranged so that the volume of said pumping chamber at the end of an ejection stroke is between one twentieth to one fourth of the volume of the pumping chamber at the beginning of the ejection stroke.

3. The pumping mechanism of claim 1, wherein said back wall has a relief in front of said outlet flap valve and said piston includes an extension attached to an upper part of said movable wall which mates with and is received in said relief at the end of each ejection stroke.

4. A trigger operated pumping mechanism for a fluid dispensing device comprising a body, said pumping mechanism comprising:

a piston having a rearwardly facing moveable wall;

a manually operated trigger movably coupled to said body;

said piston being coupled to said trigger for moving said moveable wall;

said body having a hollow cylinder therein which receives said piston and which extends to a fixed back wall in said body, whereby the space between said back wall and said moveable piston wall defines a variable volume pumping chamber;

said cylinder having a fluid inlet flap valve and a fluid outlet flap valve both associated with said back wall and each flap valve being arranged to move arcuately about a hinge line; and said valves being pressure controlled.

5. The pumping mechanism of claim 4, wherein said back wall has a relief in front of said outlet flap valve and said piston includes an extension attached to an upper part of said movable wall which mates with and is received in said relief at the end of each ejection stroke.

6. The pumping mechanism of claim 4, wherein said fluid inlet valve and said fluid outlet valve are one way valves.

7. The pumping mechanism of claim 4, wherein said fluid inlet valve and said fluid outlet valve are flap valves.

8. The pumping mechanism of claim 4, wherein said fluid inlet valve and said fluid outlet valve are positioned adjacent said back wall of said pumping chamber in close proximity to each other.

9. The pumping mechanism of claim 4, wherein said body has a lower body opening, an intake stem received in said lower body opening with a fluid inlet passageway therein, said inlet valve is integral with, and is a flap in, said back wall of said cylinder, said flap having a reduced thickness linear area for forming a hinge, said intake stem has an orifice extending therethrough to said inlet passageway; and said flap normally closes off said orifice to prevent fluid from entering said pumping chamber from the container.

10. The pumping mechanism of claim 4, wherein said body has a lower body opening, an intake stem received in said lower body opening with a flap extending upwardly therefrom, said back wall has a fluid outlet opening therethrough opposite said flap on said intake stem, said flap forming said outlet valve which normally closes said outlet opening for preventing air from entering said pumping chamber.

11. The pumping mechanism of claim 4, further comprising a venting orifice in a wall of said cylinder.

12. The pumping mechanism of claim 11, wherein said venting orifice is closed by said piston when said piston is in an at rest home position and said venting orifice is opened when said piston is moved into said cylinder.

13. The pumping mechanism of claim 4 wherein the volume of said pumping chamber at the end of an ejection stroke of said piston is minimized by constructing the inlet and outlet valves as plastic flap valves and arranging them in or adjacent to said back wall of said cylinder and by constructing and arranging said piston and said cylinder to have a minimum remaining space between said back wall and said moveable wall at the end of the ejection stroke of said piston thereby to facilitate the creation of high vacuum and high pressure during intake and ejection strokes of said piston and to facilitate priming with a minimum of strokes.

14. The pumping mechanism of claim 13 wherein said piston, said cylinder and the length of movement of said piston in said cylinder are constructed and arranged so that the volume of said pumping chamber at the end of the ejection stroke is between one twentieth to one fourth of the volume of the pumping chamber at the beginning of the ejection stroke.

15. A trigger operated pumping mechanism for a fluid dispensing device comprising a body having a hollow cylinder therein, said pumping mechanism comprising:

a piston having a rearwardly facing moveable wall received in said cylinder;

a trigger movably mounted to said body;

said piston being coupled to said trigger for moving said moveable wall in said cylinder;

said cylinder extending to a fixed back wall in said body, whereby the space between said back wall and said moveable piston wall defines a variable volume pumping chamber;

said cylinder having a fluid inlet valve and a fluid outlet valve associated with said back wall;

said valves being pressure controlled;

said back wall having a relief in front of said outlet valve; and, said piston including an extension attached to an upper part of said movable wall which mates with and is received in said relief at the end of each ejection stroke.

16. A trigger operated pumping mechanism for a fluid dispensing device comprising a body having a hollow cylinder therein, said pumping mechanism comprising:

a piston having a rearwardly facing movable wall received in said cylinder;

a manually operated trigger connected to said body;

said piston being coupled to said trigger for moving said moveable wall in said cylinder;

said cylinder extending to a fixed back wall in said body, whereby the space between said back wall and said moveable piston wall defines a variable volume pumping chamber;

said cylinder having a fluid inlet valve and a fluid outlet valve each associated with said back wall;

said valves being pressure controlled;

said body having a lower body opening;

an intake stem received in said lower body opening with a fluid inlet passageway therein;

said inlet valve being integral with, and is a flap in, said back wall of said cylinder, said flap having a reduced thickness linear area for forming a hinge;

said intake stem having an orifice extending therethrough to said inlet passageway; and, said flap normally closing off said orifice to prevent fluid from entering said pumping chamber from the container.

17. A trigger operated pumping mechanism for a fluid dispensing device comprising a body having a hollow cylinder therein, said pumping mechanism comprising:

a piston having a rearwardly facing movable wall received in said cylinder;

a manually operated trigger connected to said body;

said piston being coupled to said trigger for moving said movable wall in said cylinder;

said cylinder extending to a fixed back wall in said body, whereby the space between said back wall and said movable piston wall defines a variable volume pumping chamber;

said cylinder having a fluid inlet valve and a fluid outlet valve associated with said back wall;

said valves being pressure controlled;

said body having a lower body opening;

an intake stem received in said lower body opening with a flap extending upwardly therefrom;

said back wall having a fluid outlet opening therethrough opposite said flap on said intake stem; and, said flap forming said outlet valve which normally closes said outlet opening for preventing air from entering said pumping chamber.

* * * * *

UNITED STATES PATENT AND TRADEMARK OFFICE

CERTIFICATE OF CORRECTION

PATENT NO. : 5,332,128

DATED : July 26, 1994

INVENTOR(S) : Wilhelmus J.J. Maas and Petrus L.W. Hurkmans

It is certified that error appears in the above-indentified patent and that said Letters Patent is hereby corrected as shown below:

On the Title Page, Inventor's name "Wilhelmus J.J. Mass" should be --Wilhelmus J.J. Maas--.

Column 2, line 62, "Takaki" should be --Tasaki--.

Column 5, line 18, delete "preheld" and after "is the" insert --pre-application-to-a-bottle position and the locking ring 28 is--.

Column 7, line 27, "in" should be --is--.

Column 7, line 29, "is" should be --in--.

Signed and Sealed this

Sixth Day of December, 1994

*Attest:*

Bruce Lehman

BRUCE LEHMAN

*Attesting Officer*

*Commissioner of Patents and Trademarks*